US010797415B2

(12) United States Patent
Brodbeck et al.

(10) Patent No.: US 10,797,415 B2
(45) Date of Patent: Oct. 6, 2020

(54) CONTACT FOR A DIRECT PLUG-IN CONNECTION, AND DIRECT PLUG-IN CONNECTION

(71) Applicant: Würth Elektronik eiSos GmbH & Co. KG, Waldenburg (DE)

(72) Inventors: Michael Brodbeck, Ammertsweiler (DE); Daniel Kübler, Sulzbach Murr (DE); Anh-Nguyen Nguyen, Schwäbisch Hall (DE); Klaus Richter, Abstatt (DE)

(73) Assignee: Würth Elektronik eiSos GmbH & Co. KG, Waldenburg (DE)

( * ) Notice: Subject to any disclaimer, the term of this patent is extended or adjusted under 35 U.S.C. 154(b) by 0 days.

(21) Appl. No.: 16/444,247

(22) Filed: Jun. 18, 2019

(65) Prior Publication Data

US 2019/0393630 A1 Dec. 26, 2019

(30) Foreign Application Priority Data

Jun. 22, 2018 (DE) ..... 10 2018 210 234

(51) Int. Cl.
*H01R 13/02* (2006.01)
*H01R 12/70* (2011.01)

(52) U.S. Cl.
CPC ..... *H01R 12/70* (2013.01); *H01R 13/02* (2013.01)

(58) Field of Classification Search
CPC ..... H01R 12/70; H01R 13/02; H01R 12/585; H01R 13/193
See application file for complete search history.

(56) References Cited

U.S. PATENT DOCUMENTS 3,760,340 A * 9/1973 Friend ..... H01R 12/585 439/847
4,017,135 A * 4/1977 Taguchi ..... H01R 12/718 439/62
4,260,216 A * 4/1981 Ackerman ..... H01R 12/718 439/743
4,363,529 A * 12/1982 Loose ..... H01R 12/7058 439/82

(Continued)

FOREIGN PATENT DOCUMENTS

CN 204927573 12/2015
CN 103339802 11/2016

(Continued)

OTHER PUBLICATIONS

Dr. Klaus Von Wittig; "Lösbare Direktverbindung mit der Leiterplatte"; May 7, 2014; 6 pages.

*Primary Examiner* — Truc T Nguyen
(74) *Attorney, Agent, or Firm* — Boyle Fredrickson S.C.

(57) ABSTRACT

The invention relates to a contact for a direct plug-in connection, with a joining portion for the joining of a cable strand, and a contact portion for producing electrical contact with a passage opening in a printed circuit board, and an introducing portion forming a free end of the contact, wherein the contact portion and the introducing portion are formed on a strip of flat sheet-metal material having two side edges, a front side and a rear side, wherein, on the front side or the rear side in the contact portion, the strip has a convex bulge for bearing against the inner side of the passage opening.

14 Claims, 6 Drawing Sheets

(56) References Cited

U.S. PATENT DOCUMENTS 4,498,724 A * 2/1985 White ..... H01R 4/2458 439/391
4,780,958 A * 11/1988 Shaffer ..... H01R 12/585 29/747
5,112,249 A * 5/1992 Henry ..... H01R 9/0515 439/581
5,147,227 A * 9/1992 Yurko ..... H01R 13/41 439/733.1
5,374,204 A * 12/1994 Foley ..... H01R 12/585 439/751
5,580,276 A 12/1996 Mussen
5,898,993 A * 5/1999 Inaba ..... H01R 13/17 29/872
6,080,008 A * 6/2000 Frantz ..... H01R 4/4881 439/441
6,354,849 B1 * 3/2002 Jones ..... H01R 12/585 439/82
6,818,839 B2 11/2004 Hosaka et al.
7,377,823 B2 * 5/2008 Chen ..... H01R 12/585 439/751
8,888,541 B2 * 11/2014 Endo ..... H01R 12/585 439/751
2001/0046817 A1 * 11/2001 Putnam ..... H01R 12/585 439/751
2005/0130463 A1 6/2005 Watanabe et al.
2007/0010139 A1 1/2007 Chen
2008/0050946 A1 * 2/2008 Nunokawa ..... H01R 12/585 439/82
2013/0337697 A1 * 12/2013 Buschel ..... H01R 12/58 439/660
2015/0229056 A1 * 8/2015 Morello ..... H01R 13/18 439/370
2015/0288081 A1 * 10/2015 Bean ..... H01R 4/023 439/82
2019/0109395 A1 4/2019 Geske et al.

FOREIGN PATENT DOCUMENTS

DE 10325134 12/2004
DE 20 2016 008 242 5/2017
EP 2105995 9/2009
WO 2011155380 12/2011

* cited by examiner

CONTACT FOR A DIRECT PLUG-IN CONNECTION, AND DIRECT PLUG-IN CONNECTION

FIELD OF THE APPLICATION

The invention relates to a contact for a direct plug-in connection, with a joining portion for the joining of a cable strand, and a contact portion for producing electrical contact with a passage bore in a printed circuit board, and an introducing portion forming a free end of the contact, wherein the contact portion and the introducing portion are formed on a strip of flat sheet-metal material having two side edges, a front side and a rear side. The invention also relates to a direct plug-in connection with at least one plug and a printed circuit board, wherein the printed circuit board has at least one passage opening which is of electrically conductive design on the inner side.

BACKGROUND

A contact for a direct plug-in connection and a direct plug-in connection are intended to be improved by the invention.

SUMMARY

For this purpose, according to the invention, a contact with the features of claim 1 and a direct plug-in connection with the features of claim 14 are provided.

The contact according to the invention relates to a direct plug-in connection, with a joining portion for the joining of a cable strand, and a contact portion for producing electrical contact with a passage bore in a printed circuit board, and an introducing portion forming a free end of the contact, wherein the contact portion and the introducing portion are formed on a strip of flat sheet-metal material having two side edges, a front side and a rear side, wherein, on the front side or the rear side in the contact portion, the strip has a convex bulge for bearing against the inner side of the passage opening.

By the strip having a convex bulge for bearing against the inner side of the passage opening, the area of a contact region with the inner side of the passage opening in a printed circuit board can be increased. Above all, it is possible to process galvanized raw material since further reprocessing, especially reprocessing by means of galvanization, is dispensed with. The contact can be used in a particularly advantageous manner for what is referred to as a SKEDD direct plug-in connection. By means of the use of pretreated sheet-metal material, for example galvanized sheet-metal material, the production costs can be substantially reduced since aftertreatment, for example galvanic aftertreatment, of the contacts completed with regard to their geometry can be dispensed with.

The convex bulge can be configured in any desired manner, for example as a spherical portion, oval design, freeform surface or the like. The convex bulge is configured in such a manner that contact with the inner side of the passage opening in the printed circuit board in a spot-type, linear or surface-type manner is produced. Surface-type contacts are produced when the radii of the passage opening in the printed circuit board and the convex bulge are approximately identical, preferably are identical.

In a development of the invention, the convex bulge is spaced apart from the side edges of the strip.

Pretreated or precoated sheet-metal materials can thereby be used in a particularly advantageous manner. There especially need be no concern that, during the production of the convex bulge, after the punching the inevitably uncoated side edges will enter the region of the convex bulge and therefore the region which is provided for contacting the inner wall of the passage opening in the printed circuit board.

In a development of the invention, the convex bulge is arranged on the front side of the strip, and a concave depression is arranged on the rear side of the strip, opposite the convex bulge.

The convex bulge can thereby be realized in a particularly simple manner.

In a development of the invention, the concave depression is designed as an impression or by embossing and the convex bulge is designed as an external formation or by debossing.

By means of a simple stamping operation, the convex bulge can thereby be produced in a very simple and reliable manner.

In a development of the invention, a connecting portion is arranged between the joining portion and the contact portion, wherein the connecting portion, the contact portion and the introducing portion are formed from a strip of flat sheet-metal material, and wherein, between the connecting portion and the contact portion, the strip has a first bending point at which the strip is twisted.

By means of twisting, i.e. bending about the longitudinal axis of the strip between the connecting portion and the contact portion, the convex bulge can be arranged in the contact portion in such a manner that, when the contact is inserted into a passage opening in a printed circuit board, said bulge reliably comes into contact with the inner wall of the passage opening.

In a development of the invention, between the contact portion and the introducing portion, the strip has a second bending point at which the strip is twisted.

The introducing portion can thereby be arranged in such a manner that it can reliably fulfil the function intended for it, i.e. of permitting the secure introduction of the contact into the passage opening in the printed circuit board.

In a development of the invention, the twistings, i.e. the bendings about the longitudinal axis of the strip, at the first bending point and at the second bending point are designed in such a manner that the connecting portion of the strip and the introducing portion of the strip are oriented in a manner aligned with each other.

In this manner, therefore, only the contact portion can be arranged at an angle with respect to the connecting portion and to the introducing portion in order to obtain an optimum position of the contact portion and especially of the convex bulge, and therefore, after the contact is introduced into a passage opening in a printed circuit board, the convex bulge can produce a secure electrical contact with the inner wall of the passage opening.

In a development of the invention, the twisting angle at the first bending point and/or at the second bending point is within the range of between 35° and 55°, in particular 45°.

In a development of the invention, the contact is designed as what is referred to as a SKEDD contact, and, in the contact portion and in the introducing portion, in each case at least two strips of flat sheet-metal material are provided, said strips being arranged in a common plane in the introducing portion and each having a convex bulge in the contact portion.

By means of two strips, secure introduction into a passage opening in a printed circuit board in the manner of the tried and tested SKEDD contacts can be obtained, and, as a result of the fact that each of the strips has a contact portion with a convex bulge, an electrical contact which is sufficiently large in terms of area and is therefore reliable is realized between the convex bulges and the inner side of the passage opening.

In a development of the invention, in the contact portion, one of the strips of flat sheet-metal material is twisted by a first positive angle in relation to the common plane of the introducing portion, and, in the contact portion, the other of the strips of flat sheet-metal material is twisted by a second, negative angle in relation to the common plane of the introducing portion.

The two contact portions can thereby be arranged in such a manner that optimum contact with the inner wall of a passage opening in a printed circuit board is possible.

In a development of the invention, the first positive angle and the second negative angle are identical in absolute value.

In a development of the invention, in the contact portion and in the introducing portion, in each case at least four strips of flat sheet-metal material are provided, wherein, in the introducing portion, in each case two strips are arranged in a common plane, and, in the contact portion, all of the strips have a convex bulge.

The contact surface can be increased even further by means of four strips.

In a development of the invention, the convex bulges are each oriented in such a manner that, as seen in cross section, at least one point of each convex bulge touches a common imaginary radius.

In the event of a circular passage opening in a printed circuit board, optimum contact of the convex bulges with the inner side of the passage opening can thereby be realized.

In a development of the invention, as seen in cross section, the apex points of all of the convex bulges touch a common imaginary radius.

The problem on which the invention is based is also solved by a direct plug-in connection with at least one plug and a printed circuit board, wherein the printed circuit board has at least one passage opening which is of electrically conductive design on the inner side, and wherein the plug has at least one contact according to the invention, and the contact of the plug is inserted into the passage opening in the printed circuit board, wherein the contact touches the inner wall of the passage opening with the convex bulge.

BRIEF DESCRIPTION OF THE DRAWINGS

Further features and advantages of the invention emerge from the claims and the description below of preferred embodiments of the invention in conjunction with the drawings. Individual features of the various embodiments illustrated can be combined with one another in any desired manner without going beyond the scope of the invention. In the drawings:

DETAILED DESCRIPTION

Figure 1:
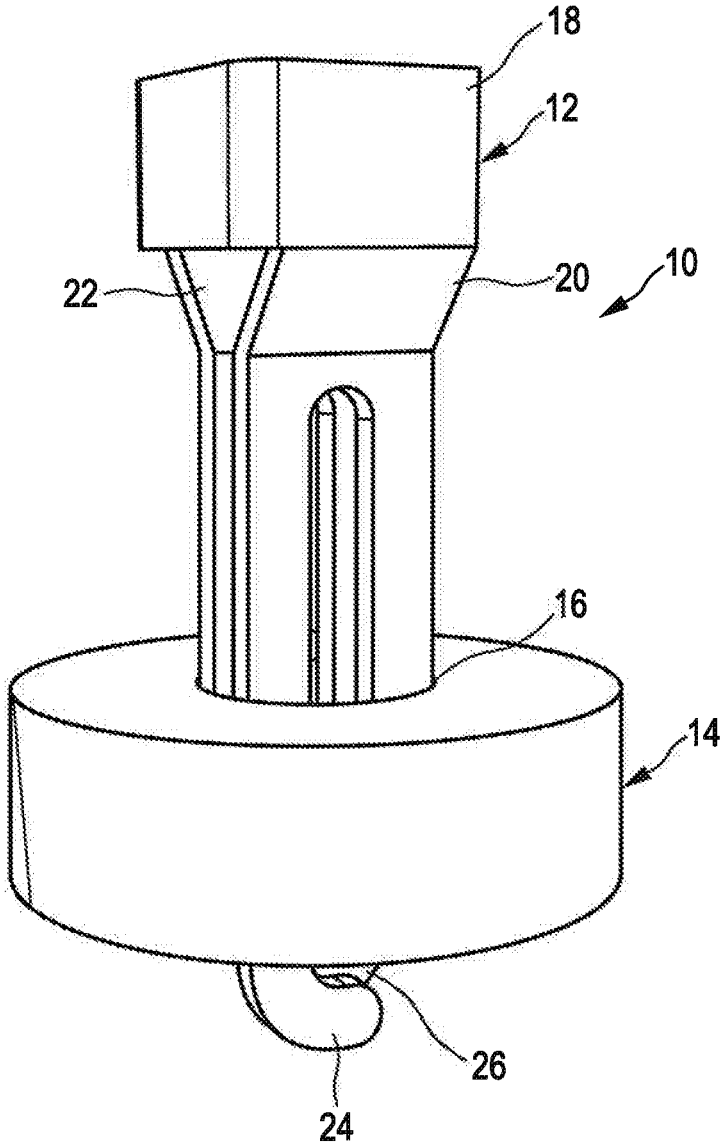
FIG. 1 shows a view of a direct plug-in connection according to the invention with a contact and a printed circuit board, illustrated in sections, obliquely from above.

FIG. 1 shows a direct plug-in connection 10 according to the invention with a contact 12 and a printed circuit board 14, only sections of which are illustrated. The printed circuit board 14 is only illustrated in the region of a passage opening 16. In a manner which cannot be seen, the passage opening 16 is of electrically conductive design on its inner wall, and the electrically conductive inner wall is electrically connected in a manner likewise not illustrated to strip conductors on the printed circuit board 14. An electrical contact with the strip conductors of the printed circuit board 14 can therefore be produced by means of the contact 12. The contact 12 can be designed either as an individual contact or can be formed of a single plug or of a multiple plug. In both cases, the contact 12 is accommodated in a housing (not illustrated) and is connected to a cable strand (likewise not illustrated). In the case of a multiple plug, a plurality of the contacts 12 are arranged next to one another in a housing, and each of the contacts 12 is then assigned a separate passage opening 16 in the printed circuit board 14.

The contact 2 has a joining portion 18 for the joining of a cable strand. The joining portion 18 is merely illustrated schematically and can be designed, for example, as an insulation displacement contact or as a crimp contact. The joining portion 18 is adjoined by two connecting portions 20, 22 which connect the joining portion 18 to in each case two contact portions which cannot be seen in FIG. 1. In the illustration of FIG. 1, the contact portions are concealed by the printed circuit board 14.

Two introducing portions 24, 26 can also be seen in FIG. 1 below the printed circuit board 14, said introducing portions permitting the contact 12 to be introduced into the passage opening 16 and being explained in more detail below.

Figure 2:
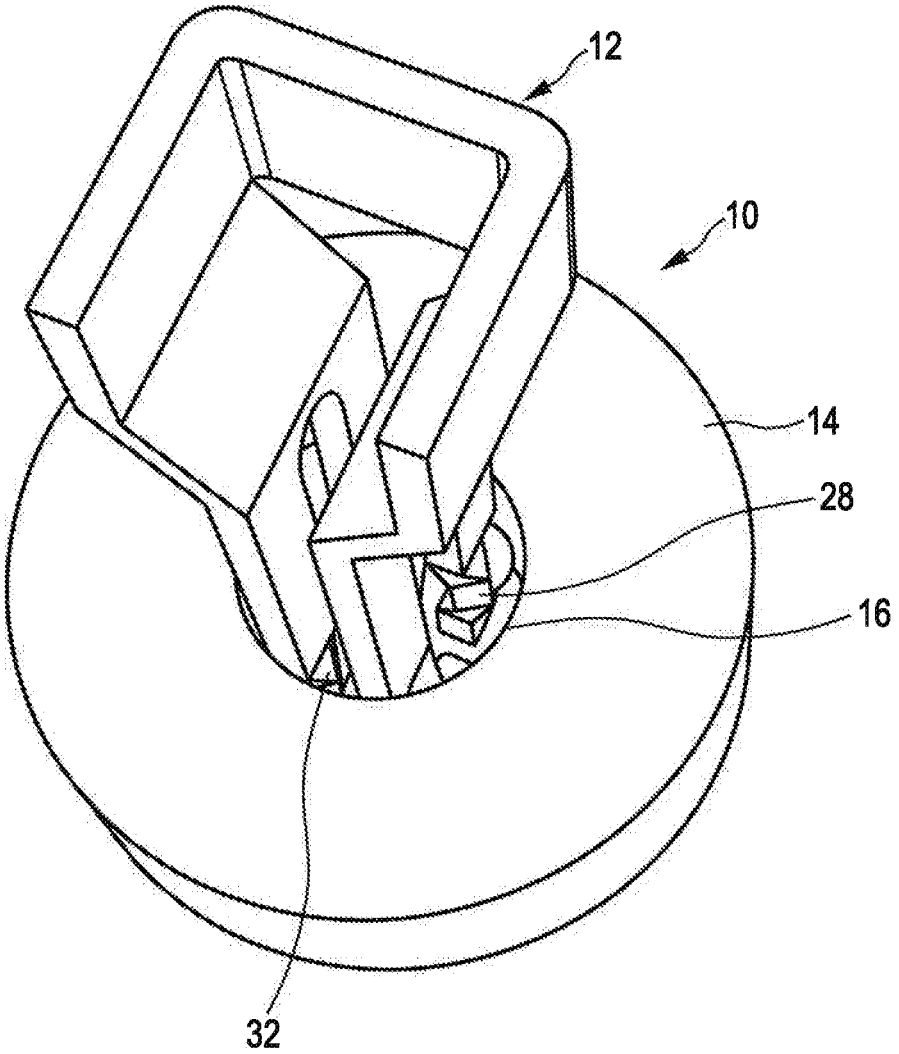
FIG. 2 shows a further view of the direct plug-in connection of FIG. 1 obliquely from above.

FIG. 2 shows the direct plug-in arrangement 10 of FIG. 1 obliquely from above. Two contact portions 28, 32, the design of which will also be explained below, can be seen in sections within the passage opening 16 of the printed circuit board 14.

Figure 3:
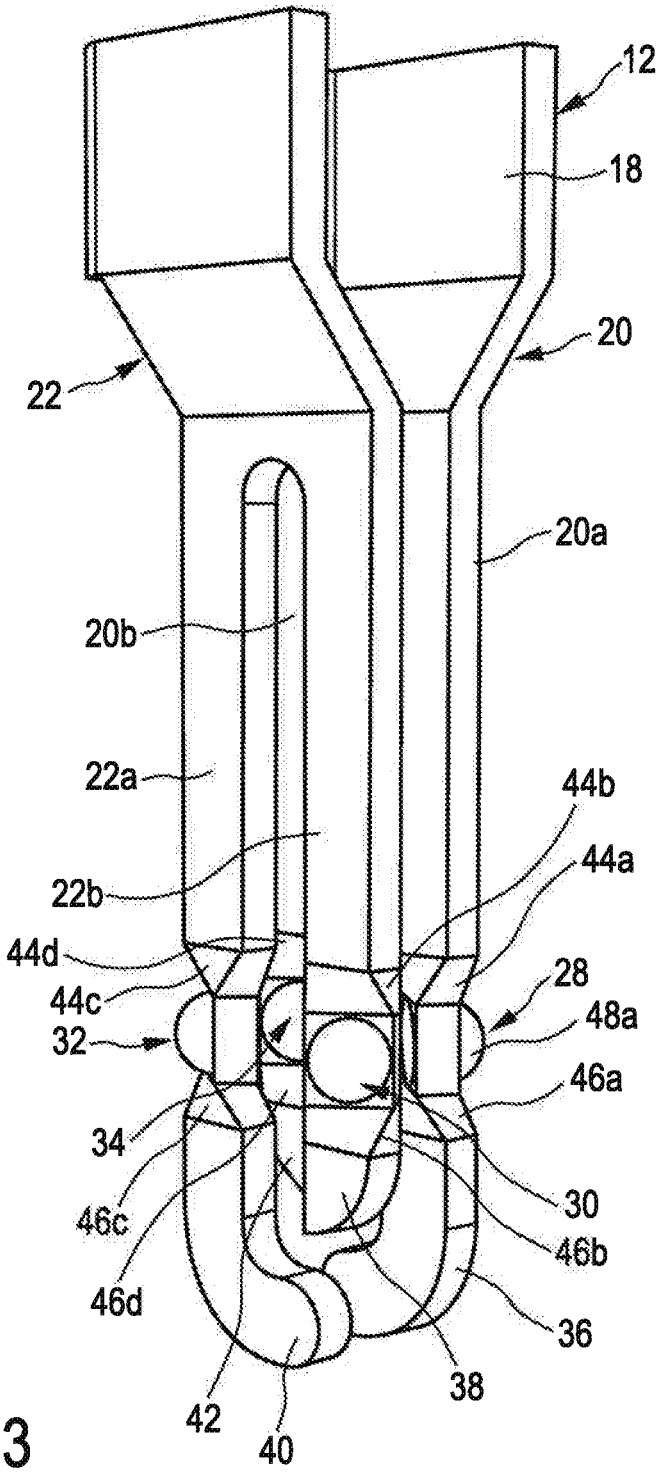
FIG. 3 shows the contact of the direct plug-in connection of FIGS. 1 and 2 obliquely from the front.

FIG. 3 shows the contact 12 in a view obliquely from above. The two connecting portions 20, 22 which emerge from the joining portion 18 can now be seen. The connecting portion 22 has two strips 22*a*, 22*b*, wherein the strip 22*a* is connected to the contact portion 32 and the strip 22*b* to the contact portion 30. The connecting portion 20 has two strips 20*a*, 20*b*, wherein the strip 20*a* is connected to the contact portion 28 and the strip 20*b* to the contact portion 34.

The contact portions 28 to 34 are each adjoined by an introducing portion 36, 38, 40 and 42. The introducing portions 36, 42 are arranged in the same plane and in alignment with each other, and the introducing portions 38, 40 are arranged in the same plane and in alignment with each other. The introducing portions 36, 40 are of approximately hook-shape design and are longer than the introducing portions 38, 42. The geometrical shapes of the introducing portions 36, 42 and that of the identically designed introducing portions 38, 40 correspond to the customary configuration of what are referred to as SKEDD contacts and permit the secure introduction of the contact 12 into the passage opening 16.

The contact 12 is produced from a sheet-metal material, wherein the sheet-metal material is punched and bent. The joining portion 18, the connecting portions 20 and 22, the contact portions 28 to 34 and the connecting portions 36 to 42 are therefore formed from strips of flat sheet-metal material. The connecting portion 20 is still designed as a single sheet-metal strip starting from the joining portion 18, but is then divided into two strips 20*a* and 20*b*. Each of said strips 20*a*, 20*b* is then connected to a contact portion 28, 34. In the same manner, the connecting portion 22 adjoining the joining portion 18 is first of all designed as a sheet-metal strip, but then is divided into two strips 22*a*, 22*b*. The strip 22*a* is connected to the contact portion 32 and the strip 22*b* is connected to the contact portion 30.

The strips 20*a*, 20*b*, 22*a*, 22*b* and the contact portions 28 to 34, which likewise are each composed of the extension of the respective strip 20*a*, 20*b*, 22*a*, 22*b*, and introducing portions 36 to 42 each have a front side, a rear side and two side edges. The front side and rear side are larger in area than the side edges. On the strip 20*a*, only the right side edge and the rear side can be seen in FIG. 3. On the strip 22*a*, the front side and the right side edge can be seen in FIG. 3. On the strip 22*b*, only the front side and the right side edge can be seen in FIG. 3. On the strip 20*b*, only the rear side can be seen in FIG. 3. The rear sides of the strips 20*a* and 22*b* and 20*b* and 22*a* respectively face each other.

It can be seen from FIG. 3 that, at the transition between the connecting portion 20 and the contact portion 34, a first bending point 44*a* is provided in which twisting of the strip 20 by approximately 45° is undertaken. In the contact portion 28, the sheet-metal strip is therefore bent by 45° in relation to the strip in the connecting portion 20. The contact portion 28 is followed by a second bending point 46*a* in which the strip is twisted again. The angle by which the strip is twisted at the second bending point 46*a* is just as large in size but is opposed to the angle by which the strip is twisted at the first bending point 44*a*. As a result, the introducing portion 36 which follows the contact portion 28 is again arranged in the same plane as the strip 20*a* in the connecting portion. By contrast, in the contact portion 28, the strip is arranged at an angle to the strip 20*a* in the connecting portion 20 and in the introducing portion 36. In the embodiment illustrated, the angle by which the strip in the contact portion 28 is twisted in relation to the connecting portion 20 and the introducing portion 36 is approximately 45° and can lie between 35° and 55° within the scope of the invention.

It can furthermore be seen in FIG. 3 that the contact portion 28 is provided with a bulge 48*a* on its front side. Said bulge is of convex design. The bulge serves to contact the inner wall of the passage opening 16 in the printed circuit board 14. By means of the convex shape of the bulge 48*a*, an electrically highly reliable contacting between the convex bulge 48*a* and the inner side of the passage opening 16 can take place. Between the convex bulge 48*a* and the inner side of the passage opening 16 there can be a point-type, linear or surface-type contact, with a surface-type contact being preferred.

The strip 20*b* is provided with a bending point 44*d* in which the strip 20*b* is twisted by an angle of approximately 45° before it merges into the contact portion 34. A second bending point 46*d* guides said twisting back again, and therefore the introducing portion 42 is arranged in the same plane as and in alignment with the strip 20*b* of the connecting portion 20.

The connecting portion 22 with the strips 22*a*, 22*b* is also formed in the same manner. The contact portions 28, 30 are each twisted by approximately 45° in relation to the strip 22*a* or 22*b*, and the introducing portions 38, 40 are then in each case arranged again in a common plane and in alignment with the strips 22*a* or 22*b*.

Each of the contact portions 28 to 34 has a convex bulge 48*a*, 48*b*, 48*c*, 48*d*. As a result, each of the contact portions 28 to 34 can ensure a reliable electrical contact with the inner wall of the passage opening 16 in the region of the convex bulge.

Figure 4:
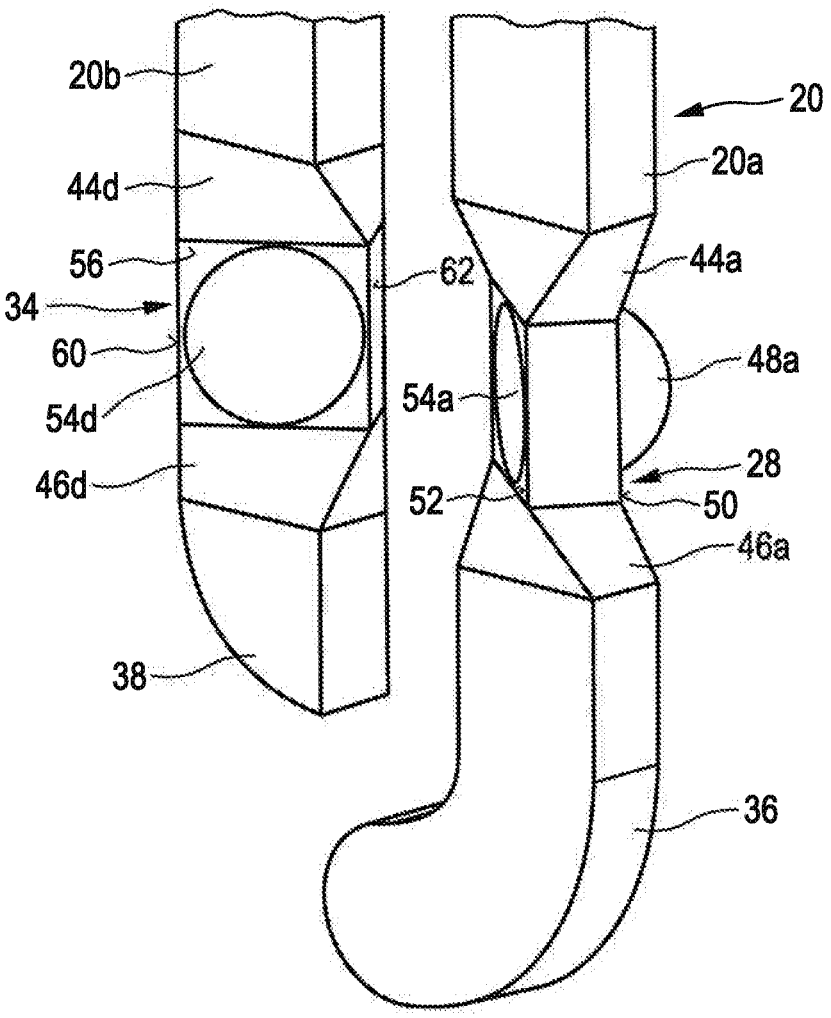
FIG. 4 shows an illustration of sections of the contact of FIG. 3 in the region of two contact portions.

The illustration of FIG. 4 shows, enlarged and in sections, the contact 12 of FIG. 3 with the strip 20*a* of the connecting portion 20, the bending point 44*a* adjoining the strip 20*a*, the contact portion 28 following the bending point 44*a*, the bending point 46*a* following the contact portion 28 and the introducing portion 36 following the bending point 46*a*. The introducing portion 36 has a curved shape at its lower end and enables the contact 12 to be introduced into the passage opening 16 in the printed circuit board 14.

The strip 22*b* of the connecting portion 20 lies in the same plane as the elements just described of the contact and is followed by a bending point 44*d*. The bending point 44*d* is followed by the contact portion 34. The contact portion 34 is followed by a bending point 46*d*. The bending point 46*d* is then followed by the introducing portion 38 which is shorter than the opposite introducing portion 36 but is of rounded design at its lower end in order to enable the contact 12 to be introduced into the passage opening 14 in the printed circuit board 16.

It can be seen that the strip 20*a*, the bending point 44*a*, the contact portion 28, the bending point 46*a* and the introducing portion 36 consist of a single strip of flat sheet-metal material which has been twisted by approximately 45° in each case in the region of the bending points 44*a*, 46*a*. It can also be seen that, in all of the portions described and illustrated in FIG. 4, said strip of sheet-metal material in each case has two side edges, a front side 50 and a rear side 52. The front side 50 and the rear side 52 have been designated in the region of the contact portion 28. In the embodiment illustrated, the contact portion 34 has the bulge 48*a* which is arranged on the front side 50. A depression 54*a* is provided on the opposite rear side 52. The bulge 48*a* is designed as an external formation or by debossing and the depression 54*a* is designed as an impression or by embossing. The bulge 48*a* is therefore produced during the impressing of the impression 54*a* by, for example, a pressing tool being pushed into the rear side 52 from the rear side 52.

The contact portion 34 in FIG. 4 can merely be seen from its rear side 56. As a result, only the depression 54*d* designed as an impression can be seen here. It can be seen with reference to the depression 54*d* that the boundary of the depression 54*d* is still arranged at a small distance from the side edges 60 and 62 of the contact portion 28. In the same manner, the opposite bulge or external formation is designed in such a manner that its boundary lies at a small distance from the side edges 60, 62 of the contact portion 28. The depression 54*a* and the bulge 48*a* are formed on the contact portion 28 in the same manner. Since the boundary of the bulge 48*a* is at a distance from the side edges of the contact portion 34, the side edges themselves are not deformed at the same time. The bulge 48*a* is therefore merely pressed out of the front side 50 of the contact portion 28. This makes it possible to use a pretreated material, for example a galvanized flat sheet-metal material, for the strip of flat sheet-metal material from which the contact 12 is produced. Following the punching out, all of the punched edges are then blank, for example the side edges 60, 62 on the left strip 20*b* in FIG. 4 and the side edges on the right strip 20*a* in FIG. 4 are in particular no longer galvanized. The side edges 60, 62 extend over the entire length of the strip 20*b*. Furthermore, all of the further punched edges are likewise no longer pretreated. However, the bulge 48*a*, the outer surface of which does indeed form the contact surface with respect to the inner wall of the passage opening 14 in the printed circuit board 16, also bears the pretreatment layer, for example the galvanization. A possible corrosion of the side edges thus does not have any influence on the electrical properties of the contact between the bulge 48*a* and the inner wall of the passage opening 16 in the printed circuit board 14. A retrospective treatment of the completed contact 12, for example by means of galvanization, can thereby be omitted. As a result, the production costs of the contact 12 can be considerably reduced.

Figure 5:
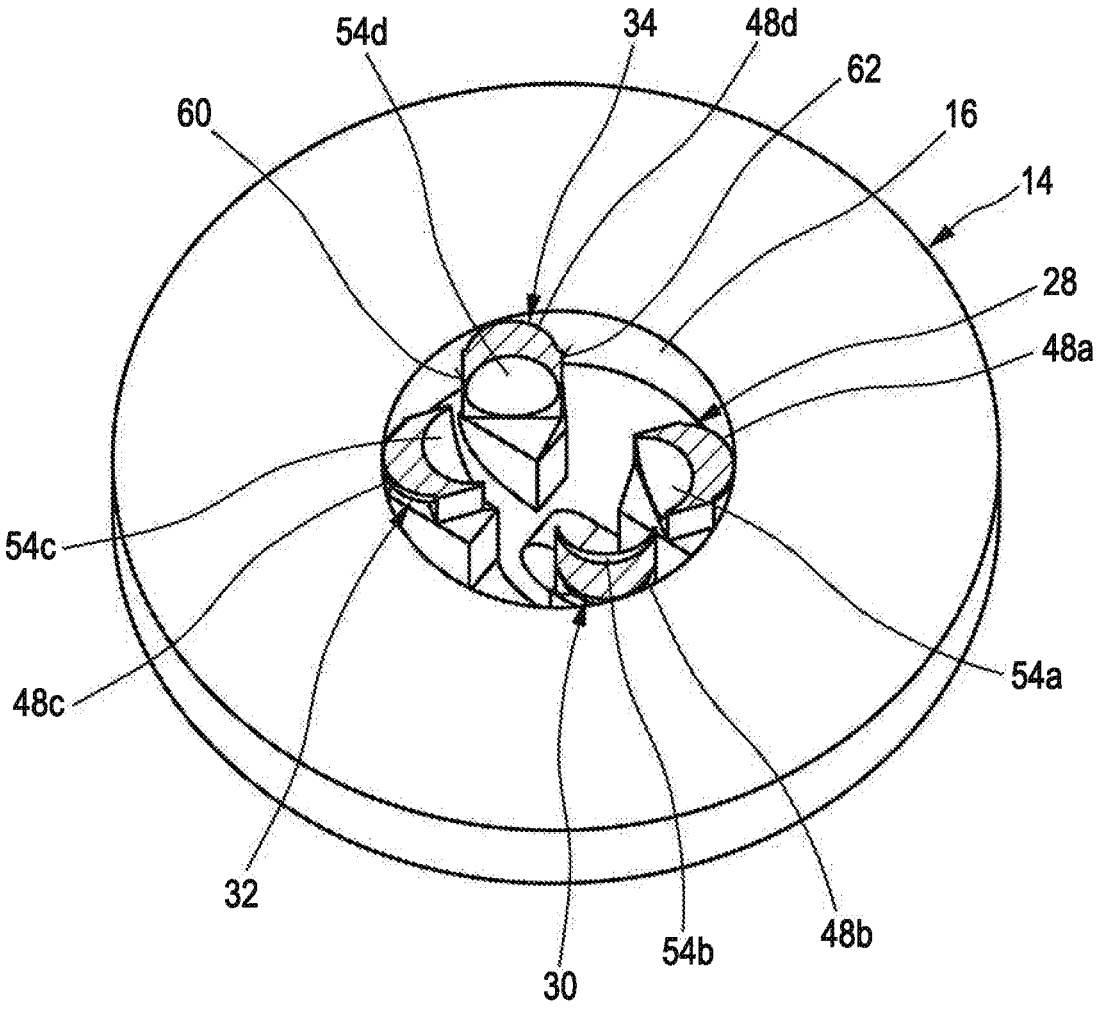
FIG. 5 shows a sectional view of the direct plug-in connection of FIG. 2.

FIG. 5 shows a sectional view of the direct plug-in connection of FIG. 1 obliquely from above, wherein a sectional plane has been arranged parallel to the printed circuit board 14 and approximately halfway up the printed circuit board 14. The sectional plane runs through the contact portions 28, 30, 32, 34 of the contact 12, cf. FIG. 3. It can be seen in FIG. 5 that the bulge 48*a* of the contact portion 28, the bulge 48*b* of the contact portion 30, the bulge 48*c* of the contact portion 22 and the bulge 48*d* of the contact portion 34 lie against the inner side of the passage opening 16 in the printed circuit board 14. As has already been stated and as can be readily seen in FIG. 5, the bulges 48*a* to 48*d* are each designed as external formations and are produced by pressing in the depressions 54*a* to 54*d*. The bulges 48*a* to 48*d* and the depressions 54*a* to 54*d* are each in the of a spherical section and are formed by the fact that a spherical-section-shaped punch is pressed into the respective rear side of the contact portions 34, 32, 30 and 28. The bulges can also be of elongate or in sections flat design. As has been stated and as can be seen in FIG. 5, there is a small distance between the side edges of the respective contact portion and the border of the respective bulge, which can be seen in FIG. 5 by a respective small shoulder between the respective side edge and the boundary of the respective bulge. With reference to the contact portion 34, the two side edges in FIG. 5 are designated by the reference numbers 60 and 62, and a small shoulder can in each case be seen between the end of the side edges 60, 62 and the beginning of the bulge 48*d* in FIG. 5.

It can furthermore be seen from FIG. 5 that the bulges 48*a* to 48*d* are arranged in such a manner that in each case at least one point of the bulges 48*a* to 48*d* lies on a common radius which is determined in the inserted state of FIG. 5 by the inner wall of the passage opening 16 in the printed circuit board 14. Also in the relaxed, non-inserted state of the contact 12, as is illustrated in FIG. 3, the bulges 48*a* to 48*d* are arranged in such a manner that at least one point of the bulges 48*a* to 48*d* lies on a common radius. In an advantageous manner, the apex point of the bulges 48*a* to 48*d* lies on a common radius.

Figure 6:
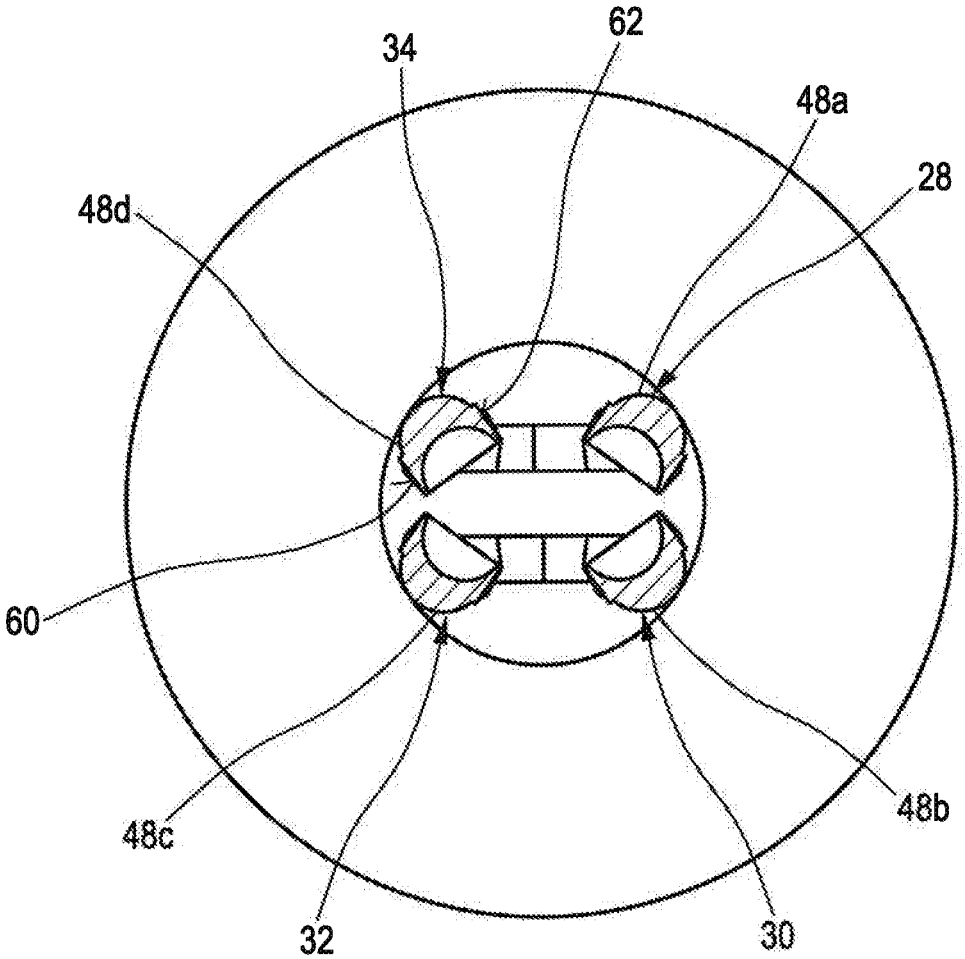
FIG. 6 shows the sectional view of FIG. 5 from a different angle.

FIG. 6 shows the sectional view of FIG. 5 in a view from above. Using the example of the contact portion 34, the shoulders between the side edges 60, 62 of the contact portion 34 and the boundary of the bulge 48*d* can be seen. It can furthermore be seen that the bulges 48*a* to 48*d* do not lie with their apex point against the inner wall of the passage opening 16 in the printed circuit board 14, but rather in a manner slightly offset laterally with respect thereto. As a result, the twisting angle by which the contact portions 28, 30, 32 and 34 are twisted can be selected to be smaller than if the contact were to take place in the respective apex point.

With the invention, the contact 12 for a direct connection can be produced substantially more favourably, without negatively influencing the operational reliability, than conventional contacts since the contact 12 can be produced from pretreated sheet-metal material, for example galvanized sheet-metal material. This can take place by punching, bending and stamping operations. However, retrospective galvanization of the completed contact 12 is no longer required since the electrical contact is produced by means of the bulges 48*a* to 48*d* which are pressed out of a flat surface, typically the front side of the pretreated sheet-metal material.

The invention claimed is:

1. A contact for direct plug-in connection, with a joining portion and a contact portion for producing electrical contact with a passage opening in a printed circuit board, and an introducing portion forming a free end of the contact, wherein the contact portion and the introducing portion are formed on a strip of flat sheet-metal material having two side edges, a front side and a rear side, wherein, on the front side or the rear side in the contact portion, the strip has a convex bulge for bearing against the inner side of the passage opening, wherein a connecting portion is arranged between the joining portion and the contact portion, wherein the connecting portion, the contact portion and the introducing portion are formed from a strip of flat sheet-metal material, and wherein, between the connecting portion and the contact portion, the strip has a first bending point at which the strip is twisted.

2. The contact according to claim 1, wherein the bulge is spaced apart from the side edges of the strip.

3. The contact according to claim 1, wherein the convex bulge is arranged on the front side of the strip, and in that a concave depression is arranged on the rear side of the strip, opposite the bulge.

4. The contact according to claim 3, wherein the depression is designed as an impression or by embossing and the bulge is designed as an external formation or by debossing.

5. The contact according to claim 1, wherein, between the contact portion and the introducing portion, the strip has a second bending point at which the strip is twisted.

6. The contact according to claim 1, wherein the twistings at the first bending point and at the second bending point are designed in such a manner that the connecting portion of the strip and the introducing portion of the strip are oriented in alignment with each other.

7. The contact according to claim 1, wherein the twisting angle at the first bending point and/or at the second bending point is within the range of between 35 angle degrees and 55 angle degrees, in particular 45 angle degrees.

8. The contact according to claim 1, wherein the contact is designed as what is referred to as a SKEDD contact, and, in the contact portion and in the introducing portion, in each case at least two strips of flat sheet-metal material are provided, said strips being arranged in a common plane in the introducing portion and each having a bulge in the contact portion.

9. The contact according to claim 8, wherein, in the contact portion, one of the strips of flat sheet-metal material is twisted by a first positive angle in relation to the common plane of the introducing portion, and in that, in the contact portion, the other of the strips of flat sheet-metal material is twisted by a second, negative angle in relation to the common plane of the introducing portion.

10. The contact according to claim 9, wherein the first positive angle and the second negative angle are identical in size.

11. The contact according to claim 1, wherein, in the contact portion and in the introducing portion, in each case at least four strips of flat sheet-metal material are provided, wherein, in the introducing portion, in each case two strips are arranged in a common plane, and, in the contact portion, all of the strips have a bulge.

12. The contact according to claim 11, wherein the convex bulges are each oriented in such a manner that, as seen in cross section, at least one point of each bulge touches a common imaginary radius.

13. The contact according to claim 12, wherein, as seen in cross section, the apex points of all of the bulges touch a common imaginary radius.

14. A direct plug-in connection with at least one plug and a printed circuit board, wherein the printed circuit board has at least one passage opening which is of electrically conductive design on the inner side, and wherein the plug has at least one contact according to at least one of the preceding claims, and the contact of the plug is inserted into the passage opening in the printed circuit board, further wherein the contact touches the inner wall of the passage opening with the bulge, yet further wherein a connecting portion is arranged between the joining portion and the contact portion, wherein the connecting portion, the contact portion and the introducing portion are formed from a strip of flat sheet-metal material, and wherein, between the connecting portion and the contact portion, the strip has a first bending point at which the strip is twisted.

* * * * *